US005531346A

United States Patent [19]

Mosior

[11] Patent Number: 5,531,346

[45] Date of Patent: Jul. 2, 1996

[54] BIOHAZARDOUS WASTE CONTAINER

[75] Inventor: Donald J. Mosior, Lake Geneva, Wis.

[73] Assignee: Sage Products, Inc., Crystal Lake, Ill.

[21] Appl. No.: 322,578

[22] Filed: Oct. 13, 1994

[51] Int. Cl.[6] ..... B65D 51/18

[52] U.S. Cl. ..... 220/254; 220/306; 220/326; 220/347; 220/351; 220/908

[58] Field of Search ..... 220/242, 254, 220/306, 324, 326, 345, 346, 347, 351, 908

[56] References Cited

U.S. PATENT DOCUMENTS

| | | | |
|---|---|---|---|
| 3,651,979 | 3/1972 | Severson | 220/346 |
| 4,842,138 | 6/1989 | Sandel et al. | 220/345 X |
| 5,107,990 | 4/1992 | Wicherski et al. | 220/345 X |
| 5,415,315 | 5/1995 | Ramirez | 220/346 |
| 5,462,189 | 10/1995 | Pierce | 220/254 |

*Primary Examiner*—Stephen K. Cronin
*Attorney, Agent, or Firm*—Lee, Mann, Smith, McWiliams, Sweeney & Ohlson

[57] ABSTRACT

A waste container having a top with a slidable closure. The top has an access aperture and the closure is positioned to slide between opened and closed positions. The closure can be temporarily retained in a first closed position over the aperture, and can be permanently retained in a second closed position over the aperture. Means is also provided for retaining the closure at partially closed orientations across the aperture.

27 Claims, 5 Drawing Sheets

Fig. 6.
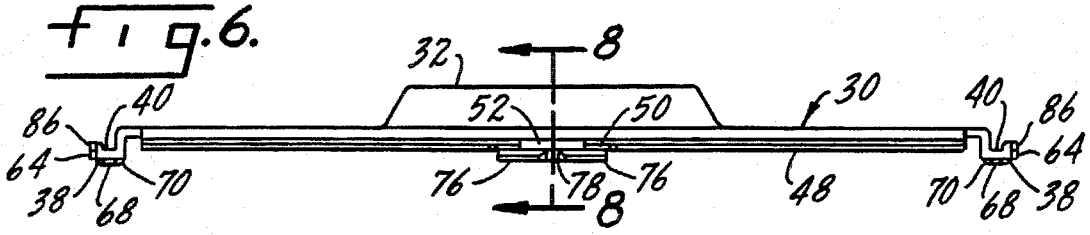
Fig. 7.
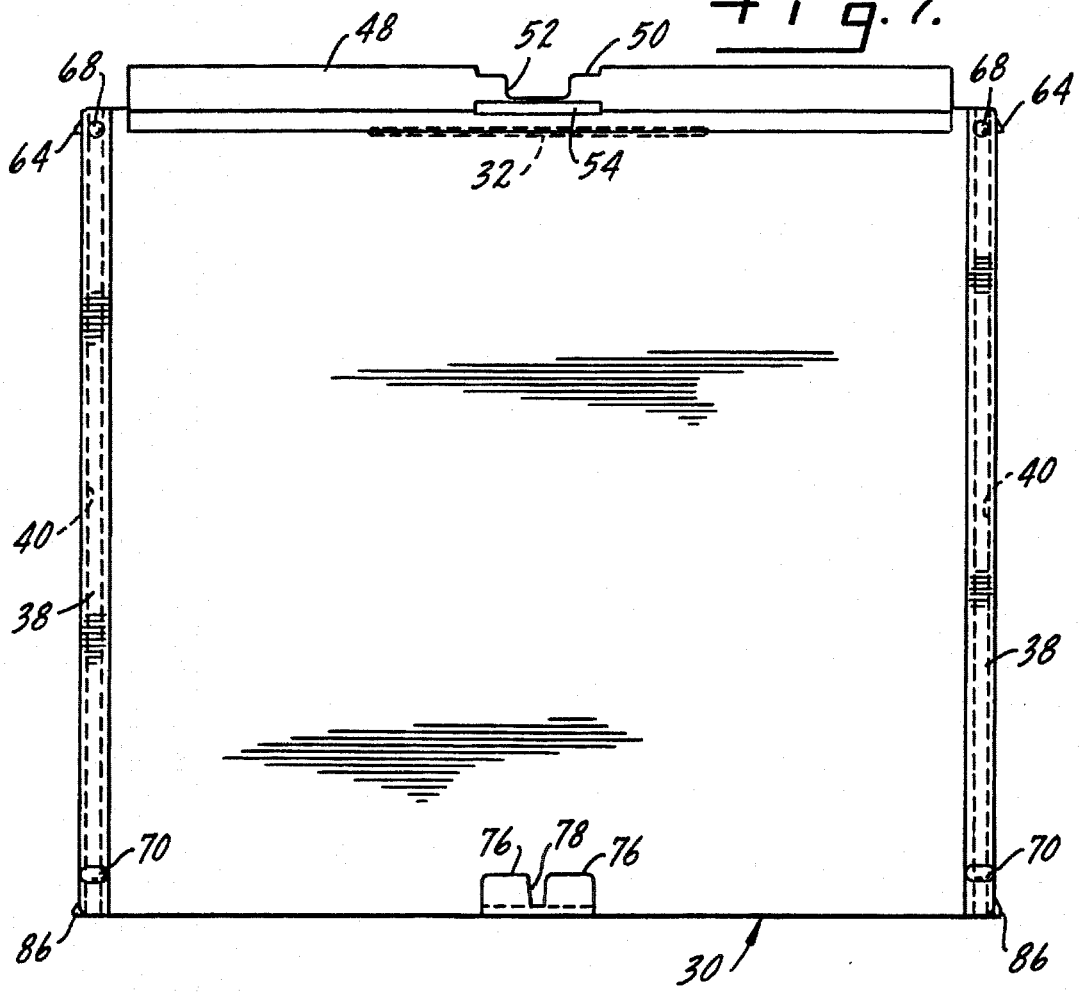
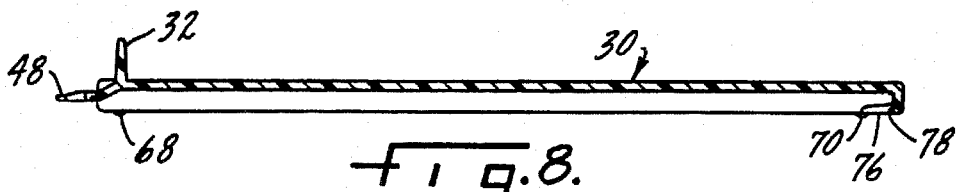
Fig. 8.

BIOHAZARDOUS WASTE CONTAINER

BACKGROUND OF THE INVENTION

This invention relates to disposal containers, and in particular to a disposal container which can be used for biohazardous waste, and which has a closure which can be closed temporarily and also permanently once the container is full or sealing of the container is desired.

Protection from the spread of infection or disease is particularly important in a hospital or other environment where treatment of patients occurs on a regular basis. For the utmost of security of hospital personnel, all items which come into contact with a patient are preferably disposed so that there is little or no chance that persons in the future will come into contact with what might be contaminated items.

Disposal of waste therefore becomes an acute concern. When dealing with a patient, disposal containers must be readily accessible, but also the containers must be designed so that other persons cannot readily access the contaminated contents. Thus, a balance between accessibility and security must be struck for maximum protection.

Many times, disposal containers are used more than once, or are used at multiple times during a surgical procedure. However, the container may only be used intermittently, and therefore should be closed when not in use so that ready access to its contents is prevented. This is particularly important when the container is used intermittently over a long period of time.

SUMMARY OF THE INVENTION

The invention is directed to a biohazardous waste container, and particularly to a unique top arrangement for the container. The top includes a lid portion, with an access aperture in the lid portion. A sliding closure is positioned to be closed over the access aperture. Guide means are provided on opposite sides of the access aperture for guiding sliding movement of the closure, with the guide means including opposite guide channels. Means is provided for temporarily retaining the closure in a first closed position over the access aperture. The temporary retaining means includes a stop to prevent sliding movement of the closure past the first closed position and a stay located in at least one of the channels. Finally, means is provided for permanently retaining the closure in a second closed position over the access aperture.

In accordance with the preferred form of the invention, holding means is also provided for retaining the closure in at least one partially closed orientation. The holding means comprises a pair of spaced ridges in at least one of the channels and a knob extending from the closure and engaging the ridges as the closure is translated. Preferably, pairs of ridges are located in both channels, and in more than one position in each channel, so that a multitude of partially closed orientations are possible.

Preferably, the top is separate from the container body for the waste disposal container. Means is therefore provided for securing the top to the container body in a permanent fashion.

The slidable closure includes a channel follower engaging each channel. Each channel follower includes a longitudinal groove in the top of the follower which is parallel to its respective channel. A pair of longitudinal covers is provided, each extending over one channel, with the cover including a depending guide extending into the groove in each channel follower.

In accordance with the disclosed form of the invention, the stay comprises a foot which extends from the closure and a corresponding depressible spring member in a channel in registration with the foot. Preferably there are spring members in each channel, butting the feet in the first position so that the closure is temporarily oriented until its opening is desired.

The means for permanently retaining the closure includes a tab extending from the lid and a lateral slot in the closure. When the closure is closed to the second position, the tab permanently engages in the slot to maintain the closure closed across the aperture. In the preferred form of the invention, the tab is located on a tongue which extends slightly into the access aperture.

To enhance the permanent retention of the closure, the invention further includes a barb on the closure which engages a barb in one of the channels. Preferably there is a fixed barb in each of the channels and a corresponding barb oriented and fixed on the closure in registration with the barbs in the channels.

The permanent closure also includes a latch member on the closure which engages beneath a lateral cross bar formed in the lid portion. The latch prevents the rear part of the closure from being raised above the lid portion.

Finally, the means for permanently retaining the closure includes a pair of the spring members, one in each of the channels. Each spring member is positioned to rise and engage a rear portion of the closure when the closure is moved to the second closed position.

BRIEF DESCRIPTION OF THE DRAWINGS

The invention is described in greater detail in the following description of an example embodying the best mode of the invention, taken in conjunction with the drawing figures, in which:

FIG. 6 is an enlarged front elevational view of the closure according to the invention, FIG. 7 is a bottom plan view thereof, FIG. 8 is a cross sectional illustration through the closure, taken along lines 8—8 in FIG. 6.

DESCRIPTION OF AN EXAMPLE EMBODYING THE BEST MODE OF THE INVENTION

Figure 1:
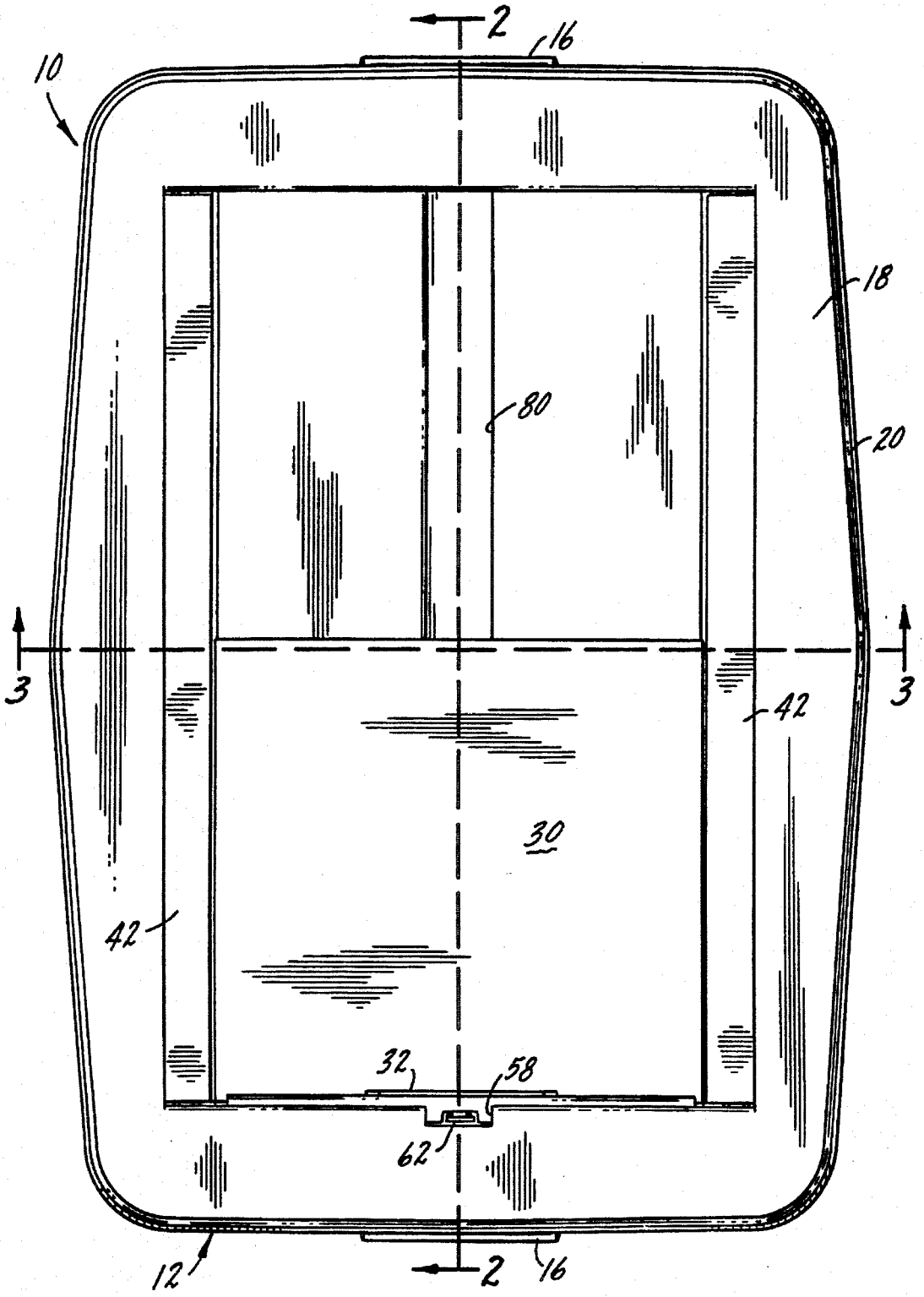
FIG. 1 is a top plan view of a waste container according to the invention, with the closure being fully closed into the second, permanent locking position.

A biohazardous waste container according to the invention is shown generally at 10 in the drawing figures. The container 10 is composed of two basic components, a top 12 and a container body 14. The top 12 may be affixed to the container body 14 in any fashion, and indeed the means of attachment can be conventional. While a particular means of attachment is illustrated in FIGS. 2–5, other means can be employed as well. For example, the container 10 can be an integral structure rather than composed of two parts, or the top 12 can be affixed to the container body by heat staking, adhesive, sonic welding or any other means.

The container body 14 may be a conventional structure, as well, and its dimensions depend on the size of the top 12 and the desired volume of the container body 14. Preferably the container body 14 (and, indeed, all components of the invention) is formed from plastic in one piece in an injection-molding process, and it is provided with handles 16 for ease of transportation.

Figures 2, 3, 4:
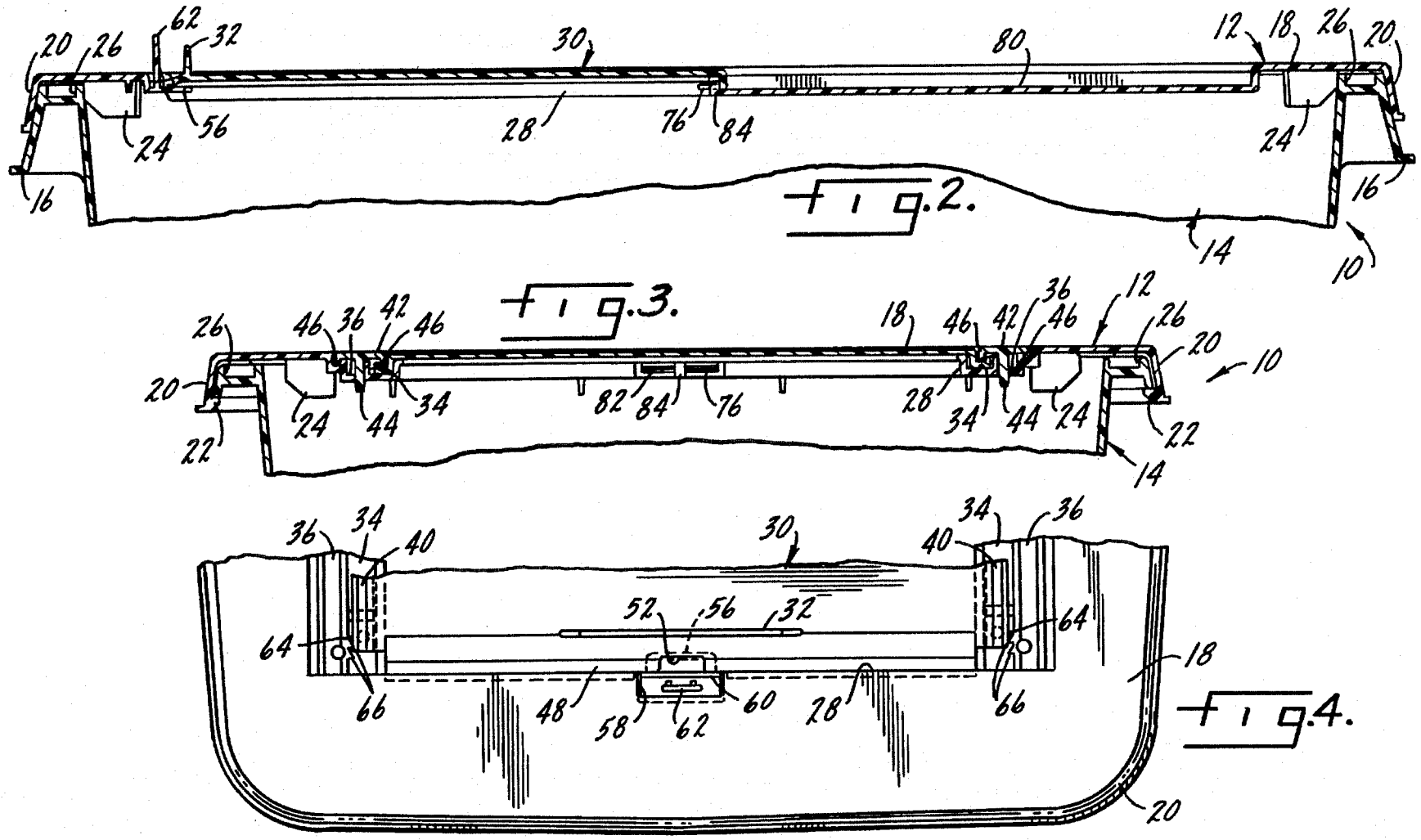
FIG. 2 is a longitudinal cross section thereof, taken along lines 2—2 of FIG. 1.
FIG. 3 is a lateral cross section thereof, taken along lines 3—3 of FIG. 1.
FIG. 4 is a partial top plan view similar to FIG. 1, but showing the closure in the first, temporary position, and also with top cover members for the opposite channels being removed in order to show detail.
Figure 5:
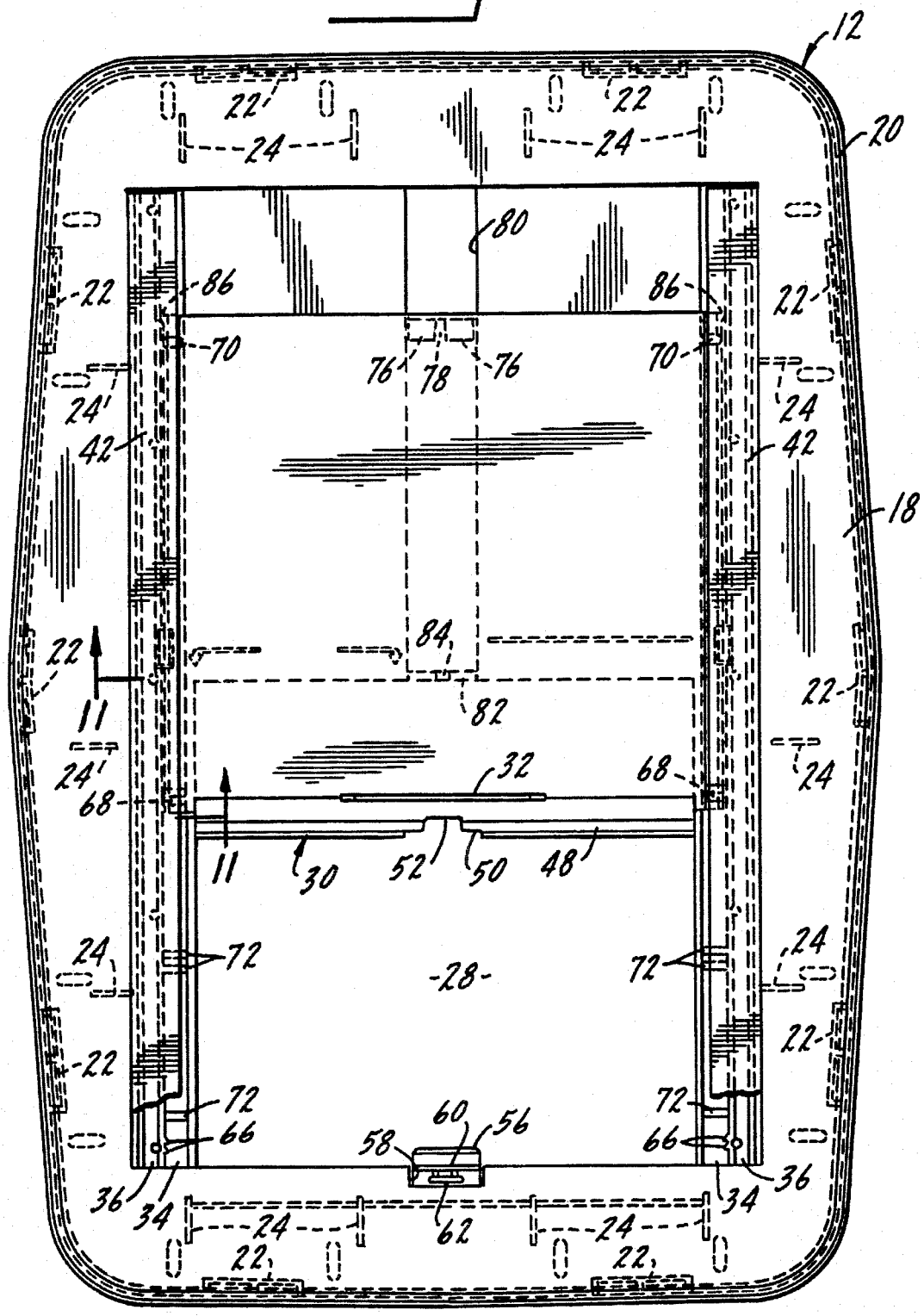
FIG. 5 is a plan view of the container top shown in FIG. 1, with the closure being partly opened across the access aperture, and showing underside detail.
Figure 9:
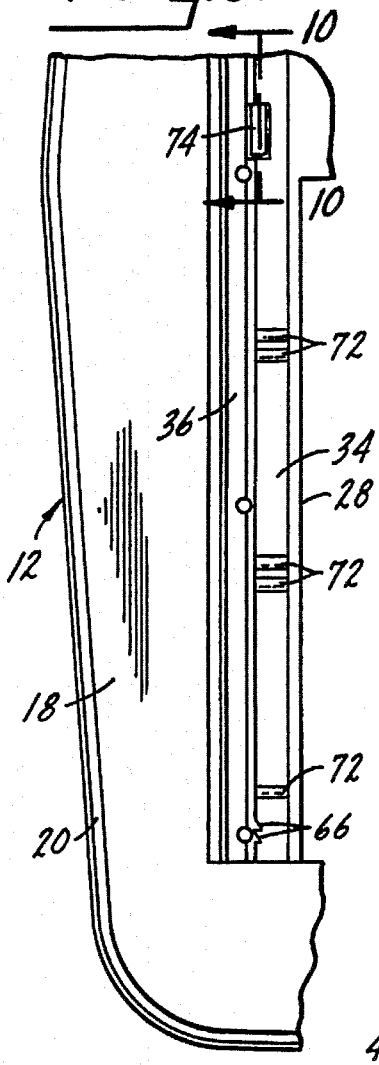
FIG. 9 is an enlarged fragmentary top plan view of a corner of the top of the waste container according to the invention, with the closure removed, and also with the top cover for the channel being removed in order to illustrate detail.

The top 12 includes a generally flat lid portion 18. The top 12 also includes a depending peripheral skirt 20 which, as best shown in FIGS. 2, 3 and 5, includes a portion of one means of affixing the top 12 to the container body 14. The skirt 20 includes a series of catches 22 and the underside of the top 12 includes a series of abutments 24 for capturing of the top rim 26 of the container body 14 between them. Such is conventional, and is not described in greater detail.

The lid portion 18 includes an access aperture 28 (best shown in FIG. 5). The access aperture 28 is sized as desired to provide access to the interior of the container 10. While a particular size of access aperture is illustrated in the drawing figures, it will be apparent that that size can vary as desired.

A sliding closure 30 is positioned to be closed over the access aperture 28. The closure 30 includes a handle 32 to facilitate sliding movement of the closure 30. The closure 30 is dimensioned to at least cover the access aperture 28 when the closure 30 is closed.

The lid portion 18 includes a guide in the form of a pair of opposite guide channels 34 on either side of the access aperture 28. As can best be seen in FIG. 2, the guide channels 34 are approximately twice the length of the closure 30 so that the closure 30 can be fully withdrawn from the aperture 28 to allow access to the interior of the container 10. Parallel secondary channels 36 are also formed to facilitate molding, but otherwise serve no purpose insofar as the function of the container 10 is concerned.

The closure 30 includes opposite legs in the form of channel followers 38, each of which engages one of the guide channels 34. Each of the channel followers 38 includes a longitudinal top groove 40 which is parallel to the guide channel 34 and whose purpose will become apparent below.

A longitudinal cover 42 extends over each of the channels 34 (and channels 36). Each cover 42 is preferably symmetrical in lateral cross section and longitudinal section for ease of assembly of the container 10. For affixing of the covers 42 to the top 12, the covers 42 include a series of depending posts 44 which pass through appropriate apertures in the top 12. The posts may be heat staked, sonically welded or otherwise treated to permanently affix the covers 42 to the top 12, capturing the closure 30 therebeneath.

Figure 11:
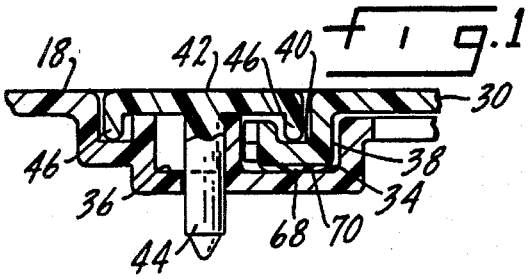
FIG. 11 is an enlarged cross sectional view through the top taken along lines 11—11 of FIG. 5.

Each of the covers 42 includes opposite depending guides 46 extending the length of the cover. Due to the symmetry of the covers 42, a pair of guides 46 is provided, although only one of the guides 46 is functional at any one time. As best shown in FIGS. 3 and 11, an inboard one of the guides 46 engages the groove 40 of the closure 30. Thus, sliding movement of the closure 30 in the guide channels 34 is also guided by the depending guides 46.

The closure 30 includes a front tongue 48 which is bisected by a cut out having a wide portion 50 and a narrower portion 52. A slot 54 is formed in the underside of the tongue 48 proximate the narrower portion 52 (as shown in FIG. 7). The slot 54 does not extend through the structure of the tongue 48.

A tongue 56 is integrally formed in a depression 58 in the lid portion 18 adjacent the access aperture 28. The tongue 56 includes an upstanding tab 60 and an actuating member 62. By depressing the actuating member 62 (from the left in FIG. 2), the tongue 56 can be depressed downwardly within the container 10.

Figure 12:
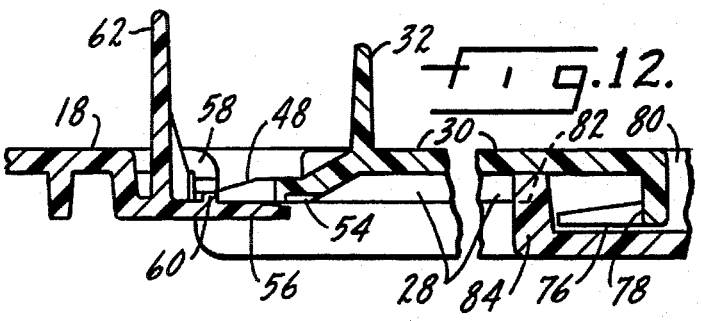
FIG. 12 is an enlarged cross sectional view centrally in the top, with portions broken away, and showing the closure in the first, temporarily closed position.

The closure 30 is positionable in two closed orientations over the access aperture 28. A first closed position is when the closure 30 is temporarily closed over the access aperture 28. This position is as best shown in FIG. 12, and is also shown in FIG. 4. In this position, the tongue 48 butts against the upstanding tab 60. Thus, the tab 60 define a limit or stop for the closure 30 in the first instance.

Figure 14:
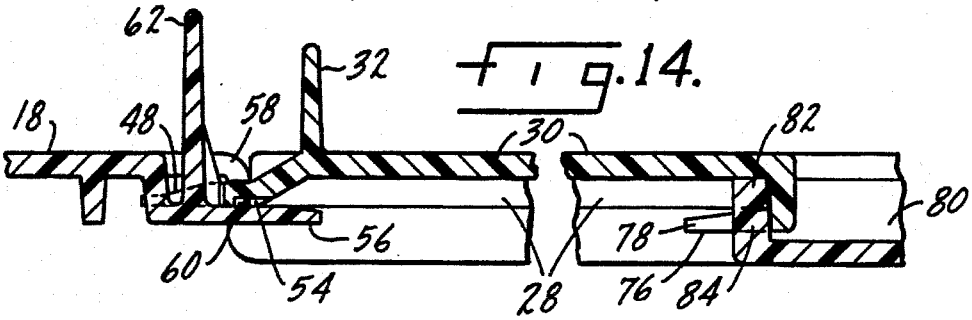
FIG. 14 is a cross sectional view through the top of the container, similar to FIG. 12, but showing the closure in the second, permanently locked position.

A second position for the closure 30 over the access aperture 28 is for permanent retention of the closure 30 in place. The second position is best shown in detail in FIG. 14, and is also shown in FIG. 1. In this orientation, the tongue 48 has passed over the tab 60, and the tab 60 is lodged in the slot 54. This is permitted by depressing the actuating member 62 (from the left in FIGS. 12 and 14), thereby lowering the tab 60 so that the tongue 48 no longer butts against the tab 60, and the closure 30 can therefore be closed further until the tab 60 can be engaged in the slot 54. At this position, the closure 30 is locked in place.

The closure 30 also includes one way barbs 64 extending from the channel followers 38, as best shown in FIG. 7. Each of the channels 34 includes a corresponding pair of barbs 66. The barbs 66 are located so that when the closure 30 is in the first closed position over the access aperture 28 when temporarily retained in place, the barbs 64 just butt against the first-encountered of the barbs 66. However, when the closure 30 is fully closed to the second, permanently closed position over the access aperture 28, the barbs 64 pass the barbs 66. The barbs 64, 66 therefore help retain the closure 30 in the permanently closed position.

The closure 30 also includes opposite depending knobs 68 at the front end thereof. A rear foot 70 extends from the rear of each of the channel followers 38. The feet 70 and the knobs 68 glide in the channel 34 to facilitate movement of the closure 30 to and fro in the channels 34.

Each of the channels also include a series of pairs of spaced ridges 72. The ridges 72 engage the knobs 68, and provide in essence a detent for holding the closure 30 at partially closed orientations across the access aperture 28. As many or as few of the ridges 72 as desired can be employed for this purpose. A single ridge 72, spaced slightly from the barbs 66, can also be employed to help retain the closure 30 in the first, temporarily closed position over the access aperture 28.

Figure 10:
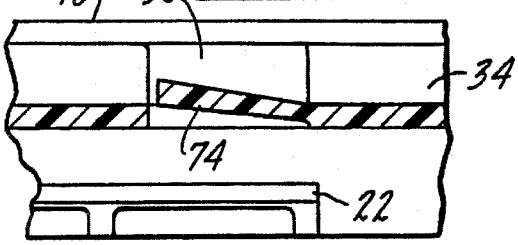
FIG. 10 is a further enlarged cross sectional illustration taken along lines 10—10 of FIG. 9.
Figure 13:
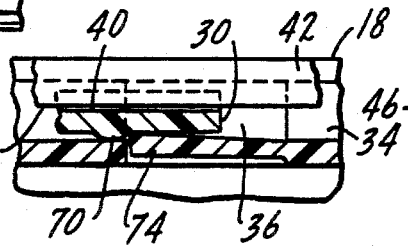
FIG. 13 is an enlarged cross sectional view in one of the channels, showing the closure in the first, temporary position and illustrating one of the spring members engaging a foot beneath the closure.
Figure 15:
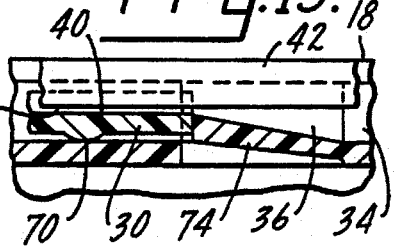
FIG. 15 is a cross sectional illustration similar to FIG. 13, but showing the closure in the second, permanently locked position and with the spring member having risen behind the closure.

A stay in the form of a spring member 74 is formed in each of the channels 34. As best shown in FIGS. 10, 13 and 15, the spring members 74 are formed with a living hinge and can be depressed by movement of the closure 30 thereover. The spring members 74 are located so that when the closure 30 is positioned in the first, temporarily closed position over the access aperture 28, the foot 70 just passes the spring member 74 (as shown in FIG. 13), and therefore the spring member 72 bears against the foot 70, tending to hold the closure 30 in the temporarily closed position. However, when the closure 30 is fully closed over the access aperture 28, the spring members 74 spring behind the closure 30 (as shown in FIG. 15) to prevent rearward movement of the closure 30 and thus help assure its locking in the second, permanently closed position.

The closure 30 also includes a latch member 76. The latch member 76 has a V-shaped groove 78 therein. When the closure 30 is assembled on the top 12, the latch member 76 extends into a wide furrow 80 formed in the lid portion 18. The furrow 80 extends almost to the access aperture 28, terminating at a cross bar 82. A central pin 84 extends from the cross bar 82 to the furrow 80 to provide structural integrity to the cross bar 82. When the closure 30 is in the first, temporarily closed position (FIG. 12), the latch member 76 is proximate the pin 84. However, when the closure 30 is fully closed across the access aperture 28 (FIG. 14), the groove 78 engages the pin 84 with the latch member 76 therefore straddling the pin 84 and with the latch member 76 captured beneath the cross bar 82. Thus, when the closure 30 is in the permanently closed position, location of the latch member 76 beneath the cross bar 82 strengthens the integrity of the permanent closing of the closure 30, helping prevent prying of the closure 30 to gain access through the aperture 28 to the interior of the container 10.

The closure 30 may also include rounded extensions 86 at the opposite end thereof from the barbs 64. The extensions 86 help guide sliding movement of the closure 30 in the channels 34, and also provide additional material against which the spring members 74 bear when the closure 30 is in the second, permanently closed position.

Various changes can be made to the invention without departing from the spirit thereof or scope of the following claims.

What is claimed is:

1. A top for a waste container, comprising a. a lid portion, b. an access aperture in said lid portion, c. a sliding closure positioned to be closed over said access aperture, d. guide means on opposite sides of said access aperture for guiding sliding movement of said closure, said guide means including opposite guide channels, e. means for temporarily retaining said closure in a first closed position over said access aperture, said means for temporarily retaining including a stop to prevent sliding movement of said closure past said first closed position and a stay located in at least one of said channels, said stay comprising a foot extending from said closure and a corresponding depressible spring member in a said channel, and f. means for permanently retaining said closure in a second closed position over said access aperture.

2. A top according to claim 1 including holding means for retaining said closure in at least one partially closed orientation.

3. A top according to claim 2 in which said holding means comprises a pair of spaced ridges in at least one of said channels and a knob extending from said closure and engaging said ridges.

4. A top according to claim 1 including means for securing said top to a container body.

5. A top according to claim 1 in which said closure includes a channel follower engaging each channel.

6. A top according to claim 5 in which each said channel follower includes a longitudinal groove parallel to said channel.

7. A top according to claim 6 including a longitudinal cover extending over each channel, each said cover including a depending guide extending into said groove.

8. A top according to claim 1 in which said means permanently retaining includes a tab extending from said lid portion and a lateral slot in said closure, said tab engaging said slot when said closure is closed over said access aperture in said second closed position.

9. A top according to claim 8 in which said tab is located on a tongue extending into said access aperture.

10. A top according to claim 8 in which said means permanently retaining further includes a barb on said closure engaging a barb in one of said channels.

11. A top according to claim 10 including at least one said barb fixed in each channel and corresponding said barbs fixed on said closure.

12. A top according to claim 8 in which said means permanently retaining further includes a latch member on said closure engaging beneath a lateral cross bar on said lid portion.

13. A top according to claim 8 in which said means permanently retaining includes a pair of said depressible spring members, one spring member being located in each channel, each spring member rising and engaging a rear portion of said closure when said closure is in said second closed position.

14. A waste container comprising, a. a container body, b. a top for said container body, c. means for securing said top to said container body, d. a lid portion of said top, e. an access aperture in said lid portion, f. a sliding closure positioned to be closed over said access aperture, g. guide means on opposite sides of said access aperture for guiding sliding movement of said closure, said guide means including opposite guide channels, h. means for temporarily retaining said closure in a first closed position over said access aperture, said means for temporarily retaining including a stop to prevent sliding movement of said closure past said first closed position and a stay located in at least one of said channels, said stay comprising a foot extending from said closure and a corresponding depressible spring member in a said channel, and i. means for permanently retaining said closure in a second closed position over said access aperture.

15. A waste container according to claim 14 in which said closure includes a channel follower engaging each channel, each channel follower including a longitudinal groove parallel to said channel.

16. A top according to claim 15 including a longitudinal cover extending over each channel, each said cover including a depending guide extending into said groove.

17. A top according to claim 14 in which said means permanently retaining includes a tab extending from said lid portion and a lateral slot in said closure, said tab engaging said slot when said closure is closed over said access aperture in said second closed position.

18. A top according to claim 17 in which said tab is located on a tongue extending into said access aperture.

19. A top according to claim 17 in which said means permanently retaining further includes a barb in each channel and a corresponding pair of barbs on said closure.

20. A top for a waste container, comprising a. a lid portion, b. an access aperture in said lid portion, c. a sliding closure positioned to be closed over said access aperture, d. guide means on opposite sides of said access aperture for guiding sliding movement of said closure, said guide means including opposite guide channels, e. means for temporarily retaining said closure in a first closed position over said access aperture, said means for temporarily retaining including a stop to prevent sliding movement of said closure past said first closed position and a stay located in at least one of said channels, and f. means for permanently retaining said closure in a second closed position over said access aperture, said means for permanently retaining including a pair of depressible spring members, one spring member being located in each channel, each spring member rising and engaging a rear portion of said closure when said closure is in said second closed position.

21. A top according to claim 20 including holding means for retaining said closure in at least one partially closed orientation.

22. A top according to claim 21 in which said holding means comprises a pair of spaced ridges in at least one of said channels and a knob extending from said closure and engaging said ridges.

23. A top according to claim 20 in which said closure includes a channel follower engaging each channel.

24. A top according to claim 23 in which each said channel follower includes a longitudinal groove parallel to said channel.

25. A top according to claim 24 including a longitudinal cover extending over each channel, each said cover including a depending guide extending into said groove.

26. A top according to claim 20 in which said means permanently retaining further includes a latch member on said closure engaging beneath a lateral cross bar on said lid portion.

27. A top according to claim 20 in which said means permanently retaining includes a pair of said depressible spring members, one spring member being located in each channel, each spring member rising and engaging a rear portion of said closure when said closure is in said second closed position.

* * * * *